United States Patent [19]

Braithwaite et al.

[11] 4,453,651

[45] Jun. 12, 1984

[54] CARTRIDGE ASSEMBLY

[75] Inventors: John D. Braithwaite; Derrick O. King, both of Berkshire; Sidney J. Williams, Surrey, all of England

[73] Assignees: Black & Decker Inc., Newark, Del.; Berger, Jenson and Nicholson Limited, London, England

[21] Appl. No.: 369,021

[22] PCT Filed: Apr. 30, 1981

[86] PCT No.: PCT/GB81/00078

§ 371 Date: Dec. 30, 1981

§ 102(e) Date: Dec. 30, 1981

[87] PCT Pub. No.: WO81/03132

PCT Pub. Date: Nov. 12, 1981

[30] Foreign Application Priority Data

Apr. 30, 1980 [GB] United Kingdom ..... 8014270

[51] Int. Cl.[3] ..... B67B 7/28

[52] U.S. Cl. ..... 222/82; 222/83; 222/389; 401/264

[58] Field of Search ..... 222/325, 326, 327, 387, 222/81, 82, 83, 389, 541, 563, 322, 391, 472, 473, 537, 567; 401/206, 264, 273

[56] References Cited

U.S. PATENT DOCUMENTS

| | | | |
|---|---|---|---|
| 184,315 | 11/1876 | Armstrong | 222/563 |
| 1,119,033 | 12/1914 | Paddock | 222/387 X |
| 2,818,999 | 1/1958 | Miller | 222/323 |
| 3,089,625 | 5/1963 | Sorber et al. | 222/398 |
| 3,217,932 | 11/1965 | Steiner | 222/95 |
| 3,242,928 | 3/1966 | Peters | 401/273 X |
| 3,284,473 | 11/1966 | Moore | 222/327 |
| 3,568,892 | 3/1971 | Burk | 222/327 |
| 3,658,213 | 4/1972 | Plumer | 222/327 X |
| 3,964,641 | 6/1976 | Langensiepen | 222/82 |

*Primary Examiner*—Joseph J. Rolla
*Assistant Examiner*—Michael S. Huppert
*Attorney, Agent, or Firm*—Edward D. Murphy; Harold Weinstein; Ronald B. Sherer

[57] ABSTRACT

A cartridge assembly for a fluent substance dispenser includes a cartridge having an elongate chamber containing a fluent substance to be dispensed and a piston mounted at one end of the chamber for movement along the chamber. The other end of the chamber is provided with an outlet for the fluent substance, and a valve member is mounted inside the cartridge over the inside of the outlet and is movable away from a closed position to an open position by a member, in the form of a nozzle, pressed against the valve member from outside the cartridge. In use the cartridge assembly is housed in a dispenser.

15 Claims, 9 Drawing Figures

CARTRIDGE ASSEMBLY

FIELD OF THE INVENTION

This invention relates to cartridge assemblies and has particular reference to a cartridge assembly containing a fluent substance, such as for example a mastic, to be dispensed. Such an assembly can be used with a dispenser which is operable to expel the substance from the cartridge.

BACKGROUND OF THE INVENTION

Such cartridge assemblies are known which comprise an elongate chamber containing a fluent substance with an outlet at one end and a piston at the other end. The outlet is commonly defined by an externally screw threaded hollow boss onto which in use a nozzle is screwed and which out of use is closed by a cap screwed onto the boss. In order to expel the fluent substance from the cartridge the piston is pushed towards the front of the cartridge.

With an arrangement of this kind it is not possible to control well the flow of substance from the cartridge.

In order to improve the control of the flow, the dispenser could be provided with a control valve between the cartridge and the nozzle outlet. However, if such a control valve were provided the valve would require cleaning each time the dispenser was used which would be a serious disadvantage to the user.

SUMMARY OF THE INVENTION

It is an object of the invention to provide an improved form of cartridge assembly.

According to the invention a cartridge assembly for a fluent substance dispenser includes a cartridge having an elongate chamber containing a fluent substance to be dispensed by means acting from one end of the chamber, the other end of the chamber being provided with means defining an outlet for the fluent substance, and a valve member mounted inside the cartridge over the inside of the outlet defining means and movable away from a closed position to an open position by pressure exerted against the valve member from outside cartridge.

Although the provision of a valve member in a cartridge assembly might seem an extravagance since once the cartridge is empty the assembly is thrown away, it is, on the contrary, advantageous. There is no cleaning of the valve member and therefore, if the nozzle used to dispense the substance is thrown away, there need be no cleaning of any part of the apparatus, which is highly advantageous to the user. Actuation of the valve member, by pressing against the valve member from outside the cartridge, is a very simple method of actuation which enables the dispenser and cartridge assembly to be of simple construction.

Said means acting from one end of the chamber may comprise a piston mounted at one end of the chamber for movement along the chamber.

The valve member may comprise a disc forming a part of a valve assembly, the valve assembly including mounting means for mounting the valve assembly in the cartridge. This valve assembly may be made in one piece with the valve member and the mounting means being integral. This enables the valve assembly to be made particularly cheaply which is an important consideration when the cartridge assembly is to be thrown away once the cartridge is empty.

The valve assembly may also include a plurality of webs extending between the valve member and the mounting means. The mounting means may be press fitted in the cartridge. This provides a very simple method of locating the valve assembly in the cartridge.

The outlet defining means may comprise an aperture in the cartridge. Alternatively the outlet defining means may comprise a portion of the wall of the cartridge which is weakened; for example, the outlet defining means may comprise an aperture in the cartridge covered over by foil which can be removed by a user to produce an aperture.

A cylindrical boss may be provided on the exterior of the cartridge around the outlet defining means, the boss having a bore therethrough aligned with the outlet defining means.

A resilient stopper may be provided for insertion into the bore of the boss. The exterior of the boss may be screw-threaded and screw-threaded securing means may be provided for engaging the screw-threaded boss to retain the stopper in the bore of the boss.

A nozzle may be provided as a part of the cartridge assembly. The base of the nozzle may be insertable into the outlet defining means and may be operative to move the valve member from the closed position to an open position when it is pressed into the cartridge.

The base of the nozzle may have foil piercing means for piercing foil covering over the outlet aperture in the cartridge. The base of the nozzle may also have foil extracting means for extracting the foil.

The nozzle may also be provided with interlocking means by which the nozzle may be engaged for movement of the nozzle into and out of the cartridge chamber.

According to another aspect of the invention there is provided a dispenser for dispensing fluent substances, the dispenser including a cartridge assembly as defined above.

The dispenser may include a housing in which the cartridge assembly is housed.

The dispenser may include manually operable means operative to press a member, which may be a nozzle, against the valve member from outside the cartridge to move the valve member from the closed position to an open position.

The manually operable means may be trigger means.

A pressurizing assembly may be supported on the dispenser, the pressurizing assembly including a housing for receiving a capsule of liquefied or pressurized gas and pressure reducing means and having an outlet for supplying gas from the capsule at reduced pressure into the cartridge behind the piston. The pressure of gas in the cartridge behind the piston may be adjustable.

BRIEF DESCRIPTION OF THE DRAWINGS

By way of example, an illustrative embodiment of the invention will now be described with reference to the accompanying drawings, of which.

DETAILED DESCRIPTION OF THE PREFERRED EMBODIMENT

Figure 1:
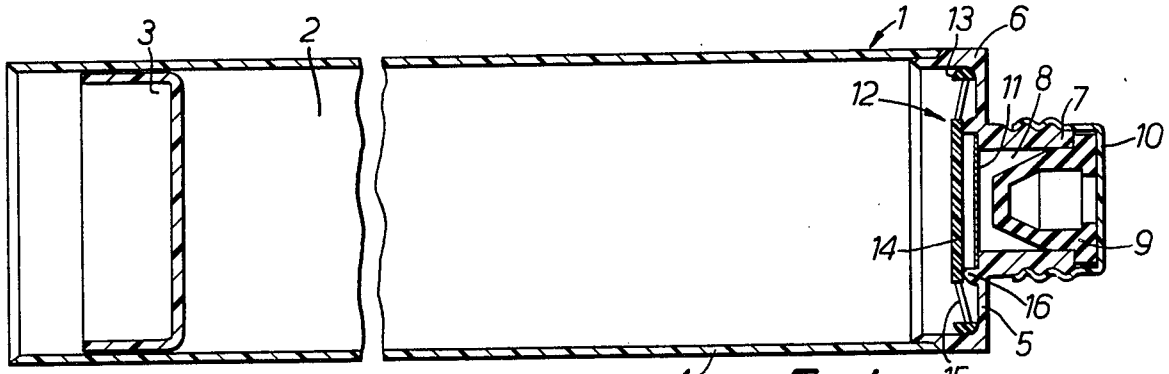
FIG. 1 is a sectional side view of a cartridge assembly.

FIG. 1 shows a cartridge assembly prior to its first use. The assembly comprises a cartridge 1 of circular cross-section having an elongate chamber 2 containing a viscous fluent substance to be dispensed, for example a mastic. At the rear end of the cartridge 1 a piston 3 is slidably mounted in the cartridge. The tubular wall 4 of the cartridge 1 may be translucent and the piston member may be coloured such that the position of the piston member can be easily seen.

The cartridge 1 is made of a plastics material which is inert to the fluent substance and has a transverse front end wall 5. In the drawing the end wall 5 is shown as part of a part 6 which is moulded separately from the tubular wall 4 and joined to the tubular wall by a spin weld. However the cartridge 1 may alternatively be moulded in one piece.

A boss 7 having a central bore 8 is centrally located on the end wall 5. A rubber stopper 9 is plugged into the end of the bore 8 and retained in position by a screw cap 10 screwed onto the outside of the boss 7.

On the interior of the end wall 5 around the bore 8 an annular rib 16 defining a valve seat is provided. The rib 16 is spaced from the circumference of the bore 8 and a circular disc 11 of a metal foil and plastics film laminate is secured over the end of the bore 8 by heat sealing the peripheral face portion of the foil to the rear face of the boss 7 inside the rib 16.

Figure 2:
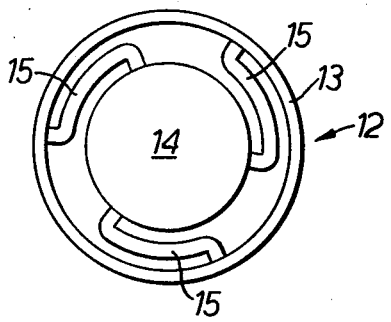
FIG. 2 is a plan view of a part of the cartridge assembly shown in FIG. 1.

A valve assembly 12 also shown in FIG. 2 is press fitted into the front end of the cartridge. The valve assembly 12 comprises mounting means in the form of an annular ring 13 which is a tight fit in the front end of the cartridge, a circular disc defining a valve member 14, and three connecting webs 15 which extend along a devious path between the ring 13 and the valve member 14 and by virtue of their length and resilience allow translational movement of the valve member 14 along the axis of the cartridge 1. The valve member 14, webs 15 and ring 13 are moulded in one piece from plastics material and when the valve assembly is unstressed the valve member 14, webs 15 and ring 13 are coplanar. As shown in FIG. 1, when the assembly is installed in the cartridge 1 the ring 13 is forward of the valve member 14 and the valve member is therefore resiliently biased against the valve seat 16.

When the cartridge assembly is to be used, a user unscrews the cap 10 and pulls out the stopper 9. The user then takes a nozzle 17 and presses the base of the nozzle through the bore 8 of the boss 7.

Figure 4:
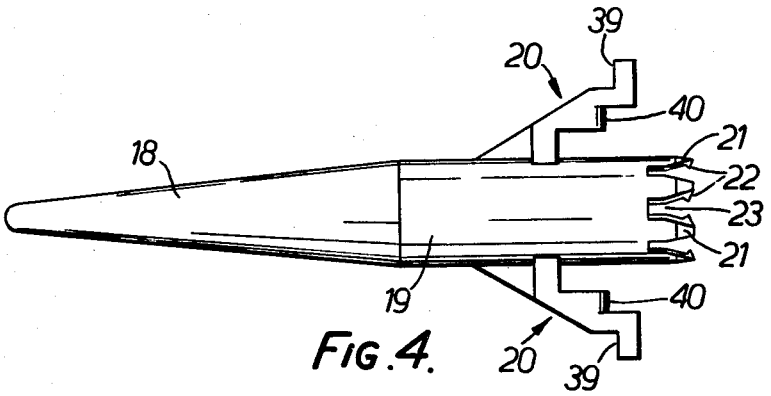
FIGS. 4 and 5 are side views perpendicular to one another of a nozzle for use with the cartridge assembly.
Figure 5:
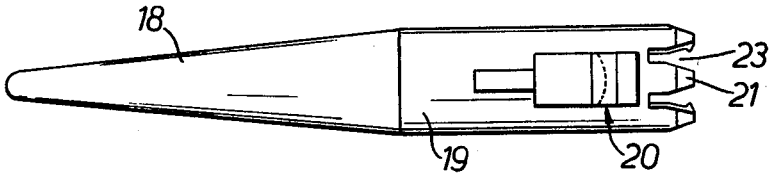

The nozzle 17 is shown in FIGS. 4 and 5. The nozzle has a tapered front portion 18 and a base portion 19 of generally cylindrical shape but provided with a pair of shaped fins 20 which provide interlocking means for a purpose which will be explained later. The cylindrical base portion 19 has an external diameter corresponding to the diameter of the bore 8 and the base end of the nozzle is provided with six axially projecting teeth 21. Between adjacent teeth 21 are passageways 23 which are tapered in the vicinity of the distal ends of the teeth but of constant width at the base of the teeth. The distal ends of the teeth are formed with inwardly protruding projections 22.

Figure 3:
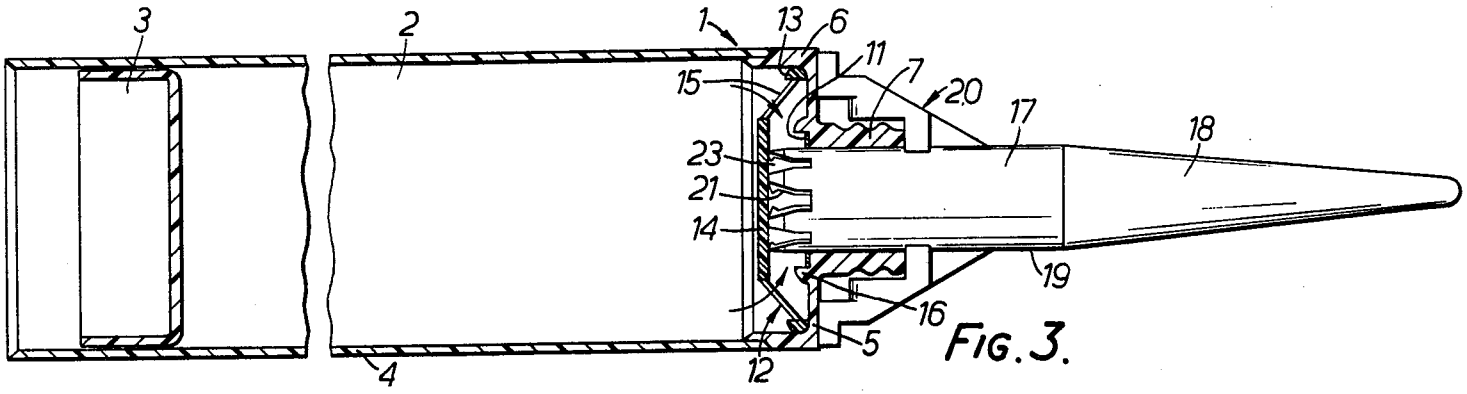
FIG. 3 is a sectional side view of the cartridge assembly during use.

When the base of the nozzle 17 is pressed through the bore 8 of the boss 7, the teeth 21 pierce the foil 11 and press against the valve member 14 moving the valve member away from the valve seat 16. FIG. 3 shows the nozzle pressed fully into the cartridge. In this position the metal foil 11 is perforated at six equispaced points around the periphery of the bore 8 but between these perforations the foil 11 lies in the passageways 23 and remains intact.

Having pressed the nozzle 17 into the position shown in FIG. 3, the user rotates the nozzle whereby the foil 11 lying within the nozzle is completely severed from the peripheral portion secured to the rear face of the boss 7. The nozzle 17 is then withdrawn and the projections 22 ensure that the severed piece of foil is withdrawn with the nozzle whereupon it can be removed by the user.

When a fluent substance in the cartridge assembly is to be dispensed, the cartridge assembly is located in a housing of a fluent substance dispenser. The metal foil 11 is severed in the manner just described, before location of the cartridge assembly in the housing of the dispenser. The nozzle is then refitted into the bore 8 of the boss 7. Means are provided on the dispenser for engaging the fins 20 of the nozzle and moving the nozzle into and out of the cartridge to move the valve member 14 between its open and closed positions.

The dispenser also includes means for driving the piston 3 towards the front end of the cartridge. The driving means may for example be a manually operated mechanical drive or a compressed air drive. Alternatively the drive man be provided by a capsule of pressurized or liquified gas.

During use, the piston 3 is driven towards the front of the cartridge 1 and the flow of the fluent substance from the chamber 2 into the nozzle through the passageways 23 is controlled by the means on the dispenser for moving the nozzle into and out of the cartridge. Movement of the nozzle into the cartridge moves the valve member 14 into its open position and after movement of the nozzle out of the cartridge the valve member returns to its closed position due to its own resilience and the net pressure of fluent substance acting upon it.

After use, the nozzle 17 is removed from the cartridge assembly and either cleaned or thrown away, the rubber stopper 9 is inserted into the bore 8 and the cap 10 screwed onto the boss 7. The tapered shape of the stopper 9 leads to very little air being trapped in the bore 8 when the stopper is located and this helps to ensure that the fluent substance in the cartridge remains in an uncured state.

Figure 6:
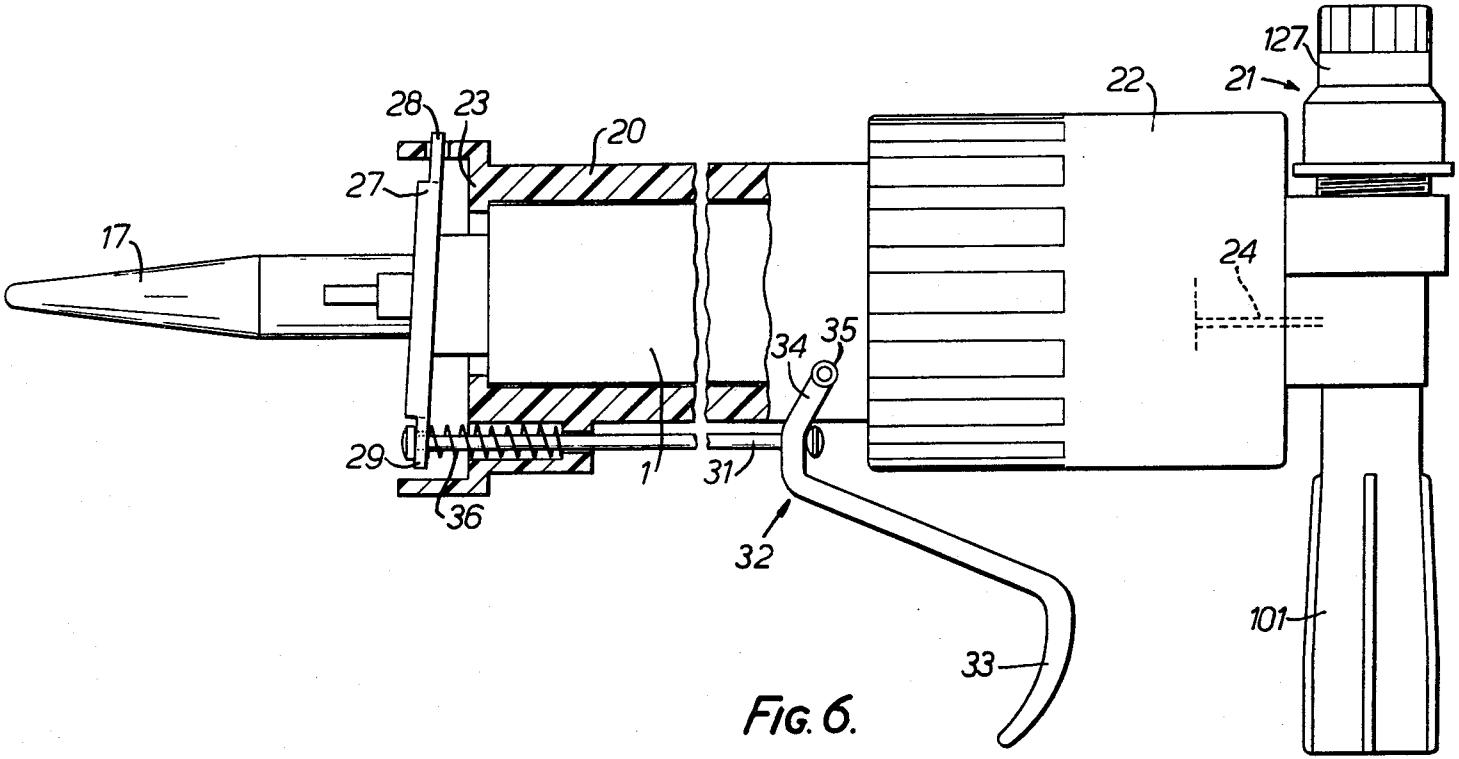
FIG. 6 is a partly sectional side view of a dispenser including the cartridge assembly of FIG. 1.
Figure 8:
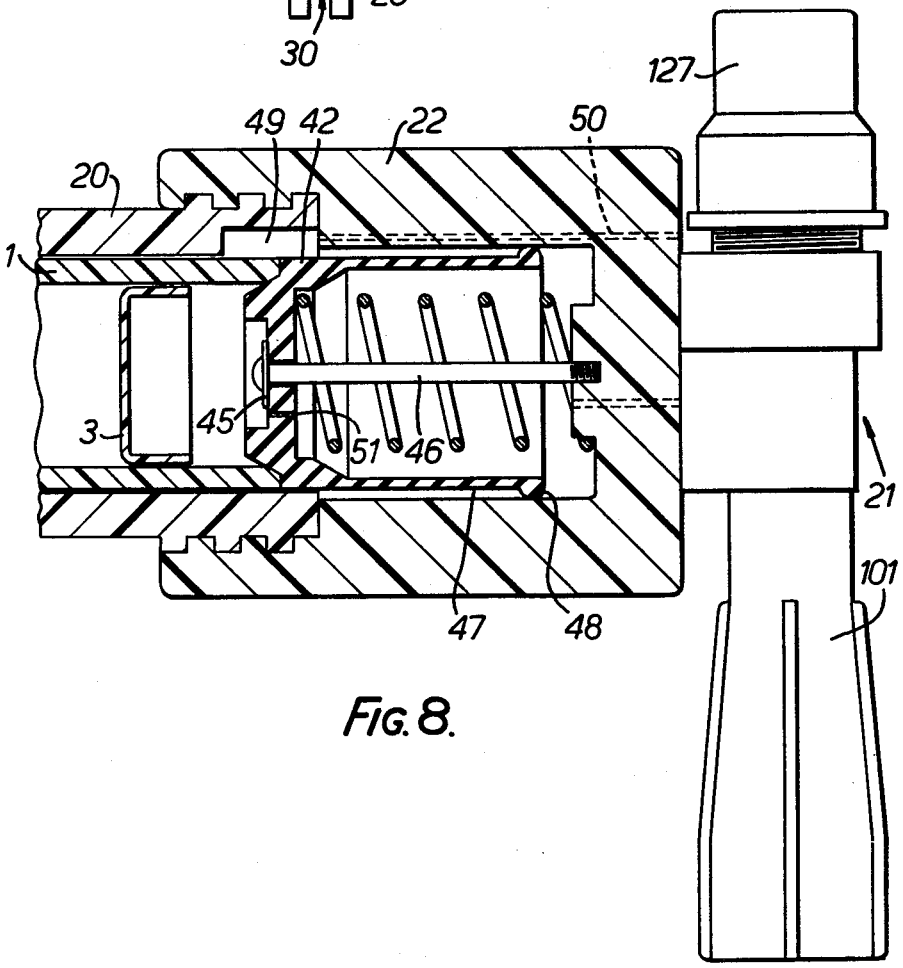
FIG. 8 is a partly sectional side view of part of the dispenser of FIG. 6.

FIG. 6 shows one particular form of dispenser in which the cartridge assembly may be housed. The dispenser includes an elongate plastics barrel 20 of generally circular cross-section defining a housing for the cartridge assembly and a pressurizing assembly 21 mounted on an end cap 22 of the barrel for supplying pressurized gas to the rear end of the cartridge 1. The end cap 22 is screwed onto the barrel. At the front end of the barrel an inwardly directed flange 23 is provided and in use the end wall 5 of the cartridge 1 abuts the flange 23 and, as shown in FIG. 8, with the end cap 22 screwed on, a seal member 42 is pressed against the rear end of the cartridge 1 by a spring 43 compressed between the cartridge and the end cap and makes a seal between the cartridge and the end cap. A passage 51 in the seal member provides a gas flow path from the pressurizing assembly 21 to the cartridge 1. The spring 43 is partly prestressed by a plate 45 secured to the end cap by a screw 46. The plate 45 also serves to retain the seal member on the end cap when it is unscrewed from the barrel. The arrangement is such that when the end cap is unscrewed from the barrel the seal with the cartridge is broken before the end cap is fully unscrewed thereby preventing sudden release of pressurized gas in the device as the end cap is separated from the barrel. The spring mounting of the seal member 42 enables a good seal to be obtained with cartridges of differing lengths and also accommodates tolerances in manufacture of the various components.

The seal member 42 has a skirt 47 which carries a peripheral sealing rib 48 at its distal end. Gas pressure from the pressurizing assembly 21 presses the skirt against the end cap enhancing the seal. The gas pressure also provides a net force, pressing the seal member 42 against the end of the cartridge 1. In the event of excess pressure, a portion of the peripheral wall of the rear end of the cartridge 1 bulges outwards into a recess 49 formed in the barrel 20 breaking the seal between the cartridge and the member 42 and allowing gas to escape through a passage 50 in the end cap. This arrangement therefore provides an overpressure safety arrangement.

In front of the flange 23 (FIG. 6) the barrel 20 is of enlarged diameter and defines a circular recess in the front end thereof. A metal plate 27 of generally circular shape (FIG. 7) is housed in the recess and has a tab 28 located in a corresponding slot in the top of the barrel. At the bottom of the plate 27 is another tab 29 having an open ended slot 30 through which one end of the slot of a control rod 31 passes. The other end of the control rod is connected to an actuating member 32. The actuating member 32 has a trigger portion 33 at its lower end and a forked pair of arms 34 at its upper end which are pivotally mounted on the barrel at 35.

A compression spring 36 mounted on the front end of the shank of the control rod biases the bottom of the plate and the control rod and trigger to a forward position.

Figure 7:
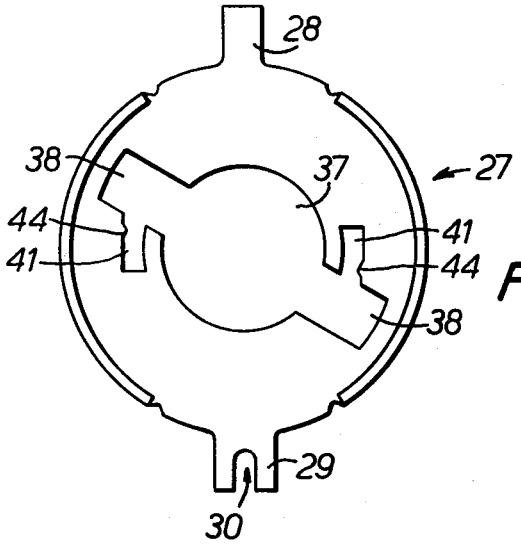
FIG. 7 is a plan view of a part of the dispenser of FIG. 6.

The plate 27 has a central hole 37 for accommodating the cylindrical base portion 19 of the nozzle 17 and a pair of radial slots 38 with associated circumferential slots 41 for accommodating the fins 20 of the nozzle. Referring particularly to FIGS. 4, 5 and 7, each fin of the nozzle has an outwardly projecting shoulder 39 facing forwardly, and an inwardly projecting shoulder 40 facing rearwardly, the shoulder 40 being spaced forwardly of the shoulder 39 by approximately the thickness of the plate.

Prior to use of the dispenser, the nozzle 17 is locked onto the plate 27 by the following steps: the nozzle is passed through the plate with the fins 20 aligned with the slots 38 until the shoulders 40 and 39 are on opposite sides of the plate. The nozzle is then rotated so that the fins 20 enter the slots 41, the shoulders 40 engage the forward face of the plate and the shoulders 39 engage the rearward face of the plate 27; as the fins 20 enter the slots 41 they are forced past small protrusions 44 which then act to retain the nozzle in position on the plate 27. In this position any forward or backward movement of the bottom of the plate 27 causes a corresponding but smaller movement of the nozzle.

FIG. 6 shows the nozzle locked onto the plate 27.

The pressurising assembly 21 provides pressurized gas to the rear end of the cartridge 1 through an outlet 24 illustrated schematically in FIG. 6. The pressurising assembly may take any of a variety of known forms but a particularly advantageous form of device is that shown in FIG. 9.

Figure 9:
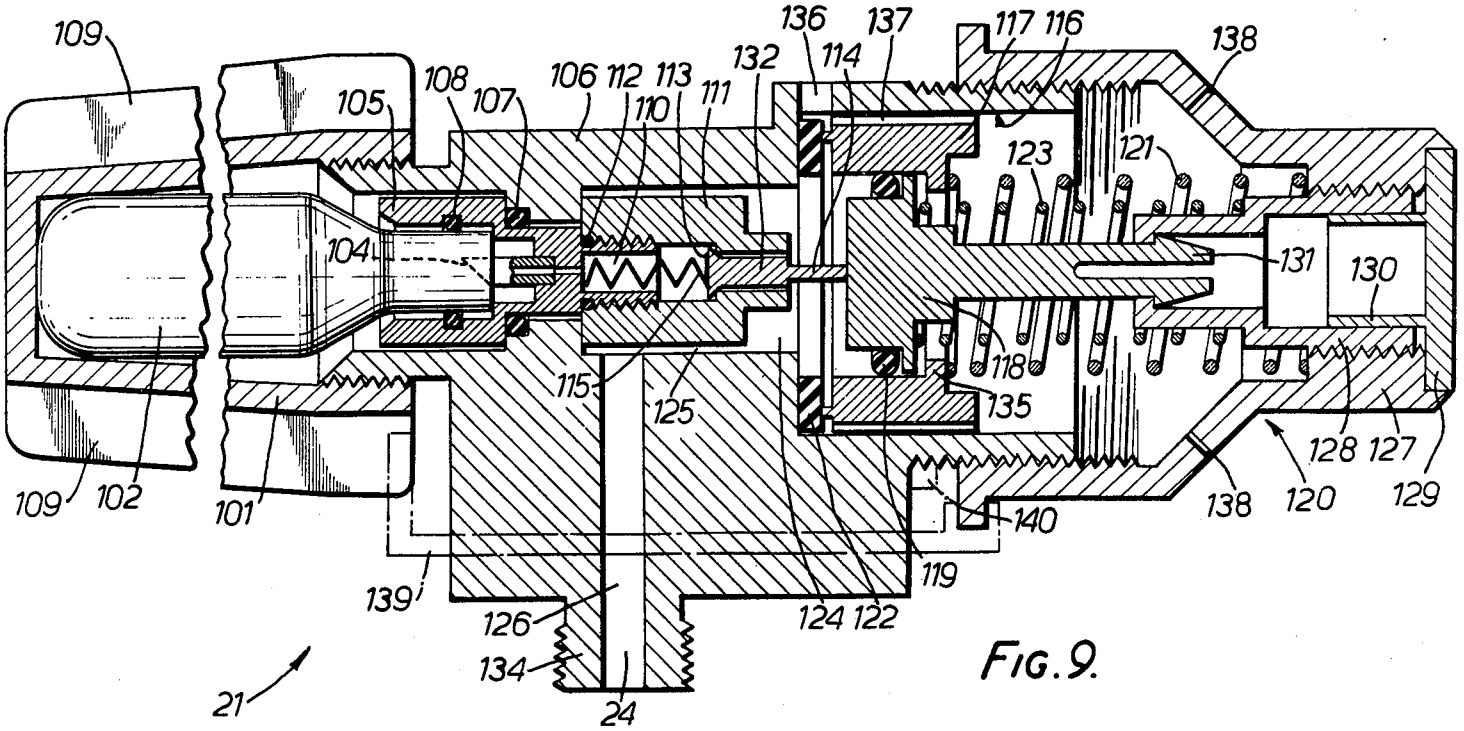
FIG. 9 is a sectional view of another part of the dispenser of FIG. 6.

The pressurizing device 21 shown in FIG. 9 includes a housing 101 for receiving a capsule 102 of liquefied or pressurised gas, for example a capsule of liquid carbon dioxide and pressure regulating means which provides a reduced pressure outlet at a regulated pressure at the outlet port 24 of the device. Safety valve means are associated with the pressure regulating means.

The arrangement for receiving the capsule 102 will now be described more fully. A capsule piercing member 105 including a piercer 104 is receiver in the body 106 of the device and an '0' ring 107 seals the interface of the piercing member 105 and the body 106. The end of the piercing member 105 adjacent the capsule housing 101 has a bore sized to receive the neck of the capsule 102 and an '0' ring 108 is seated in the bore to each the interface of the capsule neck and the bore.

The housing 101 is provided with external radially projecting fins 109.

To insert a capsule 102 into the pressurising device the housing 101 is first partially unscrewed. The capsule 102 is then placed through a side aperture in th housing 101 and the housing screwed onto the body 106. As the housing 101 is screwed onto the body 106 the neck of the capsule 102 makes sealing engagement with the piercing member 105 and at this stage the capsule is to the left of the position shown in FIG. 9 so that the capsule is not yet pierced. As the housing 101 is screwed further onto the body 106 by a user gripping the fins 109 of the housing, the housing drives the capsule on to the piercer 104 and the capsule is pierced allowing gas to flow along a fluid path from the capsule through the piercing member 105 into a chamber 110 defined by the piercing member 105 and a valve housing 111 which is screwed onto the piercing member and whose interface with the piercing member is sealed by an '0' ring 112.

To remove a capsule 102 the housing 101 is unscrewed and the capsule 102 withdrawn from the piercing member 105. In order to facilitate withdrawal of the capsule 102, the leading end of the housing may include inwardly projecting portions which surround the neck of the capsule so that when the housing 101 is unscrewed the capsule 102 is automatically withdrawn from the piercing member 105 and is then removed from the housing 101.

The chamber 110 is the high pressure chamber of a pressure regulator and safety valve assembly which will now be described. The valve housing 111 slidably receives a valve member 132 which has a closure head 113 at one end that is in the chamber 110 and a protruding stem 114 at the other end. The closure head 113 abuts a seat formed on the housing 111 and is resiliently biased by a weak spring 115 against the seat.

The right hand end (as seen in FIG. 9) of the body 106 has a bore 116 in which an approximately annular safety valve member 117 is slidably received. A piston 118 is slidably received within the safety valve member 117 and an '0' ring 119 is provided around the piston 118 to seal the interface of the piston 118 and the safety valve member 117. The bore 116 is closed by a cap assembly 120 screwed on to the exterior of the body 106.

The safety valve member 117 is inwardly biased by a compression spring 121 against a seal 122 fixed to the end wall of the bore 116, and the piston 118 is inwardly biased by a compression spring 123. In the position shown in FIG. 9 the stem 114 of the valve member 132 abuts the piston 118. A chamber 124 is defined between the valve housing 111 and the piston 118; this chamber communicates via a narrow annular duct 125 and a narrow passageway 126 with the outlet port 24.

The cap assembly 120 comprises an operating member 127 screw-threaded on the body 106, an adjusting member 128 screwed onto an axial bore of the member 127 and a closure member 129 which fits over the outer end of the axial passage in the member 127 and has a sleeve 130 with two diametral flats which engages a corresponding aperture in the adjusting member 128. Prior to insertion of the closure member 129 the adjusting member 128 may be screwed into or out of the member 127 to adjust their relative axial positions. Once the closure member 129 is fitted, however, the adjusting member 128 is concealed and locked to the operating member 127 by a force fit between the closure member 129 and the member 127. The spring 121 extends between the safety valve member 117 and the operating member 127 while the spring 123 extends between the piston 118 and the adjusting member 128.

The maximum separation of the piston 118 and the adjusting member 128 is limited by the engagement of an anchor 131 extending from the piston 118 to the adjusting member 128.

When the pressurising device is to be used, it is attached for example by means of a screw threaded boss 134 surrounding the outlet port 24 to the end cap 22. Sealing means (not shown) are provided either on the body 106 or on the end cap 22 to seal the connection of the pressurising device to the dispenser. With the pressurising device attached to the dispenser the operating member 127 is unscrewed to a position to the right of that shown in FIG. 9. As the operating member 127 is unscrewed the anchor 131 engages the adjusting member 128 and the piston 118 is drawn back. As the piston 118 is drawn back, it engages a shoulder 135 on the safety valve member 117 so that the safety valve member is drawn back. As soon as the safety valve member lifts off the seal 122, the chamber 124 is connected to atmosphere via a hole 136 in the body 106 and also via longitudinal grooves 137 formed in the outer periphery of the safety valve member and openings 138 in the operating member 127.

A stop (not shown) is preferably provided to limit the extent to which the operating member 127 can be unscrewed and define the "off" position of the operating member. With the operating member 127 in the "off" position, a capsule is inserted in the manner already described. Preferably a linkage 139, indicated schematically in FIG. 9, is provided so that the housing 101 cannot be screwed on to or off the body 106 except when the operating member 127 is in the "off" position. In the schematic illustration this is achieved by arranging for part of the linkage 139 to protrude into the path of the fins 109 of the housing except when the operating member 127 is in the "off" position.

As the capsule is pierced pressurised gas flows into the chamber 110 and the valve member 132, being closed and out of contact with the piston 118, prevents further flow of the gas.

In order to pressurise the rear end of the cartridge, the operating member 127 is screwed to the left (as seen in FIG. 9). This first allows the safety valve member 117 to return into engagement with the seal 122 thereby sealing the chamber 124 and also returns the piston 118 to the position shown in FIG. 9. As the piston 118 reaches this position it contacts the stem 114 of the valve member 132 and further movement of the piston moves the valve member 132 to the left lifting the closure head 113 off its seat. As the closure head 113 lifts off its seat pressurised gas flows into the chamber 124 through the duct 125 and passageway 126 and into the cartridge.

As the region behind the piston 3 becomes pressurised the pressure in the chamber 124 rises and urges the piston 118 outwards. The bias of the spring 123, however, acts to urge the piston inwards. Thus, once the pressure in the chamber 124 reaches a value at which the forces acting on the piston are greater than the spring bias force and any frictional force the piston 118 moves back to the right and when it reaches the position shown in FIG. 9 the valve member 132 returns to its closed position.

If the pressure in the container drops, for example as a result of mastic being dispensed from the cartridge, the force exerted by the spring 123 on the piston 118 will overcome the gas pressure force and the piston will move to the left moving the valve member 132 to its open position. Thus the piston 118 and the spring 123 regulate the pressure on the piston 3. Screwing the operating member 127 to the left compresses the spring 123 and increases the spring bias force on the piston 118 thereby increasing the regulated pressure. For maximum pressure the operating member 127 is screwed fully on to the body 106. If a lower maximum pressure is required, then this can be achieved simply by providing an insert 140 such as that shown in dotted outline between the member 127 and the body 106 to prevent the operating member being screwed fully on to the body 106.

Since the spring 123 extends between the adjustment member 128 and the piston 118 the regulated pressure also depends on the relative axial position of the adjustment member 128 relative to the operating member 127. This relative position is set in the factory according to the desired maximum pressure that is required and the closure member 129 is then located in position. A similar adjustment meas may be provided for the spring 121 to allow the pressure at which the safety valve opens to be set in the factory.

In the event of the valve member 132 becoming stuck or for some reason being ineffective in an open position, the force of pressurised gas acting on the inner face of the safety valve member 117 builds up until the resilient bias force provided by the spring 121 is overcome and the safety valve member 117 moves to the right lifting off the seal 122 and allowing pressurised gas to pass out to atmosphere through the hole 136 or via the longitudinal grooves 137 and the opening 138. In most cases a further force is provided to open the safety valve member, namely a force exerted by the piston 118 on the shoulder 135.

The safety valve member 117 moves from its closed position when the resilient bias force provided by the spring 121 is overcome. The resilient bias force depends on the position of the operating member 127 and will increase as the operating member is moved to the left. Thus the force required to move the safety valve member 117 to its open position increases as the pressure setting is increased by moving the operating member 127 to the left. In this way it is possible to arrange that the pressure in chamber 124 required to actuate the safety valve member is always a predetermined amount greater than the intended working pressure.

The pressurising device shown in FIG. 9 may be used at low pressure, for example ten pounds per square inch, to dispense a substance of low viscosity, or the device may be used at high pressure, for example fifty pounds per square inch, to dispense a very viscous mastic material. In each case, without any alteration to the assembly, the safety valve will open at a pressure a predetermined amount above the working pressure.

In the pressurising device shown, a piston 18 is used. As an alternative a diaphragm sealed to the inner wall of the safety valve member 17 and spring biased in the same manner as the piston 18 could be used, the piston 18 and '0' ring 19 being omitted. The diaphragm would be coupled to the anchor 31 to achieve the same function as the coupling of the piston to the anchor 31.

When using the cartridge assembly in the dispenser shown, the user first installs the cartridge assembly with nozzle in the dispenser as shown in FIG. 6 and then adjusts the operating member 127 to provide the appropriate pressure in the rear of the cartridge 1 for the particular fluent substance being dispensed. The user controls the extrusion of the fluent substance during use by squeezing the trigger portion 33 (the housing 101 acts as a handle). As the trigger 33 is squeezed the control rod 31 and the bottom of the plate 27 are pulled rearwardly pressing the nozzle against the valve member 14 and opening the valve member. When the user relaxes his grip on the trigger portion 33 the spring 36 returns the nozzle 17, plate 27 and control rod 31 to the position shown in FIG. 6.

A window may be provided in the barrel 20 to allow a user to see the quantity of mastic remaining in the cartridge or information, such as the type of mastic, written on the cartridge.

In the dispenser described movement of the nozzle is controlled by a trigger. This has the advantage of enabling the dispenser to be used with one hand. Various alternative arrangements could however be employed: for example, a control ring could be provided around the front of the barrel and could be rotatable relative to the barrel to move the nozzle into or out of the cartridge.

While a particular form of cartridge assembly has been described it will be appreciated that many modifications could be made to the assembly. For example the cartridge 1 may be made of cardboard lined with metal foil; the choice of material for the cartridge 1 is dependent upon the nature of the fluent substance to be dispensed since the material should be substantially inert to the fluent substance. The valve assembly 12 may also be made of metal rather than plastics material.

In some cases the piston 3 may not be necessary; for example when a substance is being dispensed by gas pressure the gas may act directly on the substance in the cartridge.

The metal foil 11 provided across the bore 8 to provide an hermetic seal prior to the first use of the cartridge may be omitted, particularly if the fluent substance in the cartridge is not particularly sensitive to exposure to air.

Since the function of the screw cap 10 is merely to retain the stopper 9 in the bore 8, the top of the cap may be perforated; also the cap 10 may be a snap fit rather than a screw fit on the boss 7. Alternatively the screw cap 10 might be fitted with an internal disc of resilient material to form a seal against the end of the boss 7 and the rubber stopper 9 would then be omitted. Another alternative would be to provide a single plastics part shaped to provide the function of both the stopper 9 and the cap 10.

The valve member 14 can be mounted in the cartridge in a variety of ways; the valve member could be in the form of a flap valve.

In the described embodiment foil piercing and extracting means are provided on the base of the nozzle. Alternative arrangements would be to mount foil piercing and extracting means on the outside of the cap or provide a separate device for piercing and extracting the foil.

What we claim is:

1. A dispenser for dispensing a fluent substance, comprising:

a housing;

a cartridge containing the fluent substance and being removably housed in said housing;

an outlet disposed at one end of said cartridge, said outlet having an interior side in communication with the interior of said cartridge and an exterior side directed away from said cartridge;

means, acting from the other end of said cartridge, for dispensing said fluent substance through said outlet;

a valve member mounted inside said cartridge for closing said outlet;

means for urging said valve member towards said outlet to close the latter;

a detachable nozzle having an inlet end and a dispensing end, said inlet end being insertable through and withdrawable from said outlet from said exterior side thereof, said valve member closing said outlet when said nozzle is withdrawn therefrom and detached from said dispenser;

means for moving said nozzle in use inwardly and outwardly in said outlet, whereby said nozzle is moved inwardly into said cartridge to displace said valve member and open said outlet to dispense said fluent substance, and said nozzle is moved outwardly to effect closing of said outlet by said valve member; and said moving means comprising actuating means mounted on said housing and engaged with interlocking means on said nozzle externally of said cartridge by relative movement of said actuating means and said interlocking means.

2. The dispenser of claim 1, wherein said outlet comprises a boss having a bore therethrough, said boss extending from an end wall of said cartridge.

3. The dispenser of claim 2, further including a closure member comprising a plug insertable in said bore.

4. The dispenser of claim 2, wherein said interlocking means comprises two fins extending outwardly from said nozzle adjacent said inlet end thereof, said fins fitting over said boss and each having outwardly of said boss an outwardly projecting shoulder facing forwardly and an inwardly projecting shoulder facing rearwardly.

5. The dispenser of claim 2, wherein said end wall has on the interior side thereof a raised valve seating surrounding the interior side of said outlet.

6. The dispenser of claim 1, wherein said valve member is mounted by a plurality of webs connected between said valve member and said cartridge.

7. The dispenser of claim 6, wherein said urging means comprises said webs.

8. The dispenser of claim 7, wherein said webs each extend along a devious path.

9. The dispenser of claim 1, wherein said actuating means comprises a trigger connected to a plate having a hole therethrough, said plate being pivotally mounted on said housing with said nozzle extending through said hole, and said interlocking means comprises fins extending from said nozzle and engaging said plate.

10. The dispenser of claim 9, wherein said plate has slots therein outwardly of and communicating with said hole, and said fins releasably engage in said slots.

11. The dispenser of claim 10, wherein said fins each have a forwardly facing shoulder and a rearwardly facing shoulder engaging opposite sides of said plate.

12. The dispenser of claim 1, where said means for dispensing said fluent substance comprises a piston movable along said cartridge;

and further comprises a pressurizing assembly mounted on said housing;

said pressurizing assembly comprising a housing for receiving a capsule of pressurized gas, pressure reducing means, and having an outlet for supplying gas from the capsule at reduced pressure into the cartridge behind said piston.

13. The dispenser of claim 12, wherein the housing for receiving the capsule of pressurized gas extends laterally from the housing in which said cartridge is housed and forms a handle for said dispenser.

14. The dispenser of claim 1, wherein the interior side of said outlet is covered by foil, and the inlet end of said nozzle has foil piercing and extracting means for piercing the foil and extracting the foil from the cartridge before said fluent substance is dispensed.

15. The dispenser of claim 14, wherein said nozzle has at said inlet end a plurality of teeth having passageways therebetween for passage of said fluent substance, and said teeth have formed at the distal ends thereof inwardly protruding projections, said teeth and said projections comprising said foil piercing and extracting means.

* * * * *